United States Patent [19]

Ohki et al.

[11] Patent Number: 4,575,972

[45] Date of Patent: Mar. 18, 1986

[54] GRINDING MACHINE FOR USE WITH ROLLING MILL

[75] Inventors: Toshio Ohki; Masaomi Matsumoto, both of Chiba; Takashi Sakuraya, Higashimurayama; Keinosuke Tokushige; Shuji Hoshino, both of Funabashi, all of Japan

[73] Assignees: Kawasaki Seitetsu Kabushiki Kaisha, Hyogo; Ishikawajima-Harima Jukogyo Kabushiki Kaisha, Tokyo, both of Japan

[21] Appl. No.: 577,248

[22] Filed: Feb. 6, 1984

[30] Foreign Application Priority Data

Feb. 25, 1983 [JP] Japan ..... 58-29236

[51] Int. Cl.[4] ..... B21B 28/02; B24B 21/02

[52] U.S. Cl. ..... 51/251; 51/242; 51/135 R

[58] Field of Search ..... 51/242, 251, 252, 253, 51/254, 135 R, 137, 139

[56] References Cited

U.S. PATENT DOCUMENTS

| | | | |
|---|---|---|---|
| 2,579,391 | 12/1951 | Minarik | 51/251 |
| 2,710,500 | 6/1955 | Bolger | 51/242 |
| 3,496,679 | 2/1970 | Dunn | 51/135 R |
| 3,524,285 | 8/1970 | Rutt | 51/139 |
| 4,488,382 | 12/1984 | Zajac et al. | 51/165.92 |

FOREIGN PATENT DOCUMENTS

| | | | |
|---|---|---|---|
| 2365924 | 1/1977 | Fed. Rep. of Germany | 51/242 |
| 145356 | 11/1979 | Japan . | |

*Primary Examiner*—Roscoe V. Parker

[57] ABSTRACT

Disclosed is a grinding machine for use with a rolling mill capable of carrying out the continuous grinding operation of the cylindrical or rolling surface of a work roll without removing the work roll from the rolling mill while the continuous rolling operation is being carried out, whereby labor saving can be attained and the downtime of the rolling mill can be remarkably reduced.

17 Claims, 9 Drawing Figures

GRINDING MACHINE FOR USE WITH ROLLING MILL

BACKGROUND OF THE INVENTION

The present invention relates to a grinding machine for use with a rolling mill and more particularly a grinding machine capable of continuously grinding the cylindrical or rolling surface of a work roll without removing the work roll from the rolling mill.

In general, the work rolls of a rolling mill tend to be locally worn out at the portions corresponding to the edges of a slab or the like being rolled and the rolling surfaces of the work rolls are worn and roughened so that the rolling surfaces of the work rolls must be periodically ground. According to the conventional methods, the worn work rolls are removed from the rolling mill and are ground while the rolling operation is stopped. As a result, a lot of work and a long time are needed. Furthermore, the rolling surfaces of the work rolls are ground by means of a rotary grinding wheel so that the grinding wheel surface tends to be "loaded". As a result, frequent dressing (removal of loading) is needed so that it takes a long time to grind the cylindrical or rolling surface of a work roll.

One of the objects of the present invention is therefore to provide a grinding machine for use with a rolling mill capable of continuously grinding the cylindrical or rolling surface of a work roll of a rolling mill without the need of removal of the work roll and further without dressing, whereby labor saving can be attained and the continuous rolling operation can be carried out without any interruption.

The above and other objects, effects, features and advantages of the present invention will become more apparent from the following description of preferred embodiments thereof taken in conjunction with the accompanying drawings.

BRIEF DESCRIPTION OF THE DRAWINGS

The same reference numerals are used to designate same parts throughout the figures.

DESCRIPTION OF THE PREFERRED EMBODIMENTS

First embodiment, FIGS. 1-6

Figure 1:
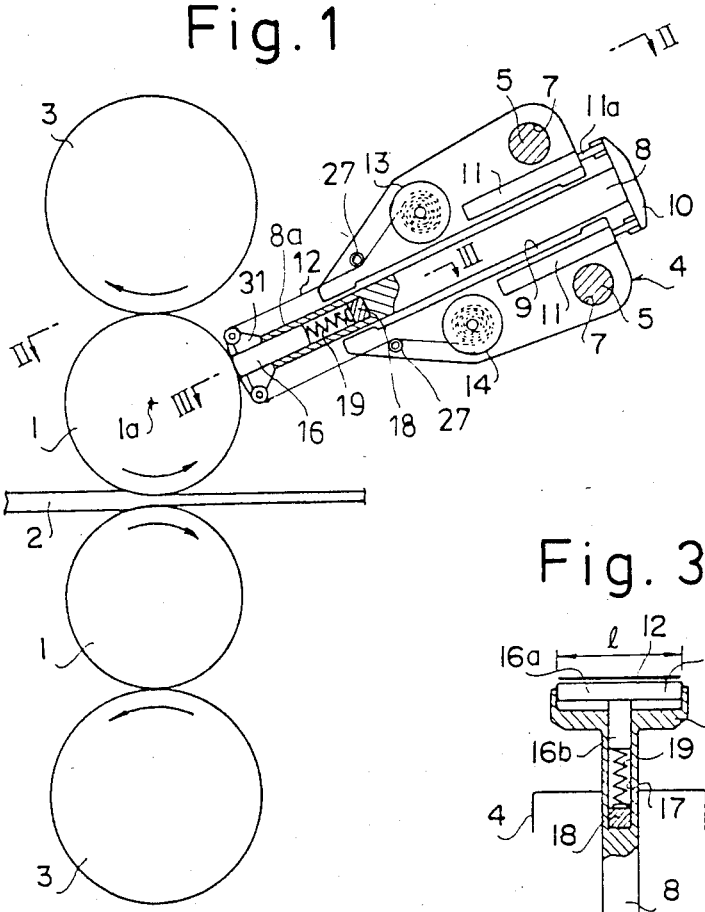
FIG. 1 is a cross sectional view of a first embodiment of a grinding machine in accordance with the present invention.
Figure 2:
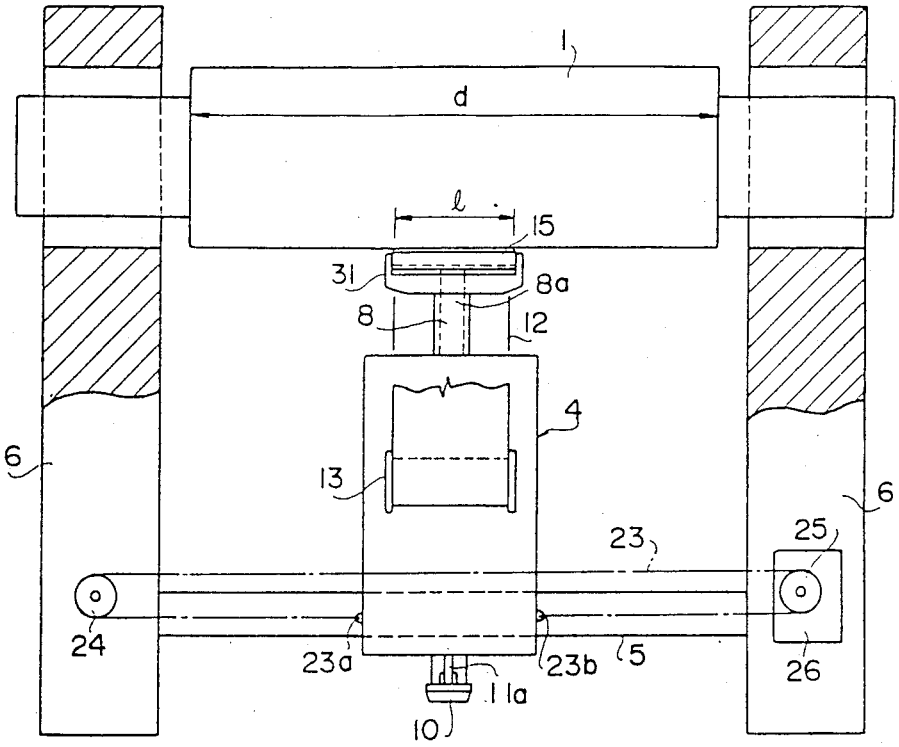
FIG. 2 is a sectional view taken along the line II—II of FIG. 1.

Referring first to FIGS. 1 and 2, reference numeral 1 denotes work rolls; 2, a workpiece being rolled; and 3, backup rolls. Grinding machines in accordance with the present invention are respectively disposed adjacent to the upper and lower work rolls 1 in order to grind the cylindrical surfaces of the work rolls 1. The grinding machine is provided with a pair of traverse guide beams 5 which are parallely spaced apart from each other by a suitable distance. The traverse guide beams 5 are parallely spaced apart from the work roll 1 by a suitable distance and are supported at their ends by housings or supporting frames 6 which support the ends of the work roll 1. The main body 4 of the grinding machine is guided by the traverse guide beams 5 so as to be displaced in parallel with respect to the work roll 1.

The main body 4 is provided with guide beam holes 7 into which are fitted the traverse guide beams 5 and a bore 9 into which is fitted a supporting rod 8. The supporting rod 8 can slidably move in the axial direction of the bore 9 and has a leading end portion **8*a* which can be moved toward or away from the axis 1*a* of the work roll 1. The rear end of the supporting rod 8 is formed integral with an end plate 10 which is connected to piston rods 11*a* of hydraulic cylinders 11 disposed within the main body 4 in parallel with the bore 9. As the hydraulic cylinders 11 are actuated, the supporting rod 8 is extended out of or withdrawn within the cylindrical bore 9 so that the leading end portion 8*a* of the supporting rod 8 is moved away or toward the work roll 1**.

A pair of reels 13 and 14 around which is wound an abrasive belt 12 are disposed in symmetrical relationship with respect to the axis of the bore 9 of the main body 4 and are drivingly coupled to drive means (not shown). One of the reels 13 and 14 is a take-up reel while the other reel is a supply reel. The abrasive belt 12 extends along the leading end portion **8*a* of the supporting rod 8 and has a grinding surface bonded with abrasive particles. The width l of the abrasive belt 12 extending in front of the leading end portion 8*a* of the supporting rod 8 as well as the width of the main body 4 are smaller than the width d of the work roll 1 (See FIG. 2**).

Figure 3:
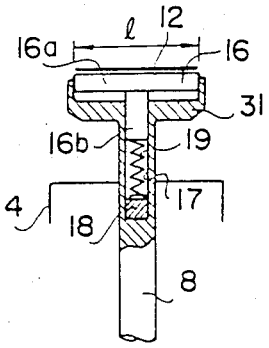
FIG. 3 is a sectional view taken along the line III—III of FIG. 1.

As best shown in FIG. 3, a member 16 for pressing the abrasive belt 12 against the cylindrical or rolling surface of the work roll 1 is attached to the leading end portion **8*a* of the supporting rod 8. The pressing or pressure member 16 comprises a belt supporting member 16*a* and a mounting member 16*b*. The belt supporting member 16*a* is adapted to support the back surface of the abrasive belt 12 and is subtantially equal in width to the belt width l. The mounting member 16*b* extends at right angles relative to the belt supporting member 16*a* from the center portion thereof and is axially slidably fitted into a mounting hole 17 formed in the supporting rod 8 and extends in the axial direction thereof from its leading end 8*a*. The belt supporting member 16*a*** may be in the form of a roller.

A load cell 18 for measuring the force applied thereto is disposed within the mounting hole 17 and a spring 19 is loaded between the mounting member **16*b* and the load cell 18. The force with which the pressing member 16 is pressed against the work roll 1 acts as a reaction force against the load cell 18 through the spring 19 and therefore is detected by the load cell 18. In response to the output signal from the load cell 18, the hydraulic cylinders 11 are so controlled that the force applied from the pressing member 16 to the work roll 1 can be maintained constant. The spring 19 serves to cause the pressing member 16 to make intimate contact with the cylindrical or rolling surface of the work roll 1**.

A hydraulic control unit (not shown) is provided so that the working fluid is forced into or out of the hydraulic cylinders 11 which cause the supporting rod 8 to extend out of or to be withdrawn into the bore 9.

Figure 4:
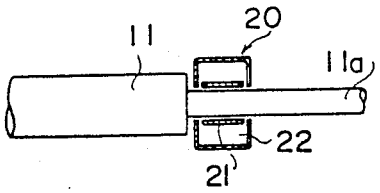
FIG. 4 is a sectional view of a locking machanism for a hydraulic cylinder.

Each of the hydraulic cylinders 11 is provided with a locking mechanism 20 (See FIG. 4) which is adapted to lock the piston rod 11*a* of the hydraulic cylinder 11 except when the supporting rod 8 is actuated. For instance, as best shown in FIG. 4, the locking mechanism 20 comprises a friction member 21 which is adapted to lock or unlock the piston rod 11*a* and a pressure chamber 22. When the working fluid is forced into the pressure chamber 22, the friction member 21 is caused to lock the piston rod 11*a*. When the cylinder 11 is actuated so that its piston rod 11*a* is extended or retracted, the working liquid is discharged from the pressure chamber 22 so that the friction member 21 unlocks the piston rod 11*a* and consequently the piston rod 11*a* can freely move. The working fluid may be oil or air.

Figure 6:
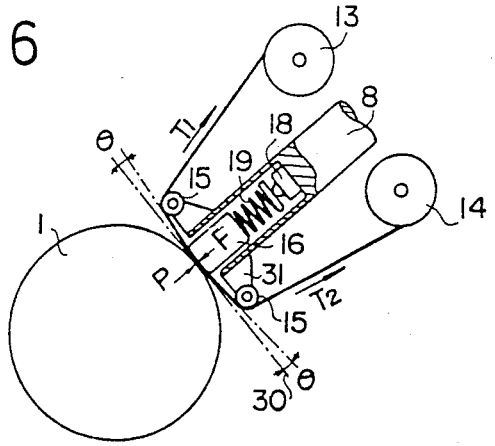
FIG. 6 is a cross sectional view used for the explanation of a belt holding means.

Referring particularly to FIG. 6, a pair of belt holding rollers 15 are disposed adjacent to the leading end portion 8*a* of the supporting rod 8 for the purpose of causing a predetermined length of the abrasive belt 12 to be kept as flat as possible in the direction of the tangent line 30. Thus, the belt holding rollers 15 serve to minimize the axial force exerted on the pressing member 16 by the tensions of the abrasive belt 12. The width of the belt holding rollers 15 is substantially equal to the width of the belt supporting member 16*a* of the pressing member 16. Each of the belt holding rollers 15 is rotatably carried by a bracket 31. Therefore when the pressing member 16 is pressed against the work roll 1 under a predetermined force or pressure (so that the pressing member 16 is forced to be retracted into the mounting hole 17 against the spring 19), the angle $\theta$ between the abrasive belt 12 supported by the supporting member 16*a* of the pressing member 16 and the tangent line 30 can be minimized.

Let P denote the force with which the abrasive belt 12 is pressed against the work roll 1; F, the force applied to the load cell 18 through the spring 19; and $T_1$ and $T_2$, the tensions applied to the abrasive belt 12 in the directions of the reels 13 and 14, as shown in FIG. 6. Then the following relationship is established:

$$F=P+(T_1+T_2)\sin\theta$$

It follows that in order to control with a high degree of accuracy the pressing force P exerted by the abrasive belt 12 on the work roll 1, it is preferable that F=P. Therefore the belt holding rolls or means 15 are provided so that the angle $\theta$ between the tangent line 30 and the abrasive belt 12 (which is referred to as "the extended angle of the abrasive belt 12" for brevity in this specification) may be minimized and consequently the second term in the right part of the above equation becomes negligible.

Next referring particularly to FIG. 2, a mechanism for traversing the main body 4 of the grinding machine with the above-described construction will be described. Sprocket wheels 24 and 25 are respectively mounted on the supporting frames 6, and a chain 23 is wrapped around the sprocket wheels 24 and 25. Both ends 23*a* and 23*b* of the chain 23 are securely fixed to the main body 4. The sprocket wheel 25 is drivingly coupled to drive means 26. Therefore, as the drive means 26 is energized, the sprocket wheel 25 is rotated so that the chain 23 is driven and consequently the main body 4 is traversed along the traverse guide beams 5.

It is to be understood that instead of the sprocket wheel and chain mechanism, any other suitable traversing mechanism, such as a hydraulic cylinder, may be used.

Next the mode of operation of the first embodiment with the above-described construction will be described. The abrasive belt 12 is driven in the direction opposite to the direction of rotation of the work roll 1. That is, in FIG. 1, the belt 12 is unwound from the upper reel 13 and is wound around the lower reel 14. To this end, prior to the grinding of the work roll 1, all the belt 12 is wound around the upper reel 13. The abrasive belt 12 is driven by the reels 13 and 14 which in turn are driven by drive means (not shown). The abrasive belt 12 is rewound at a relatively slow speed. If there exists a relative velocity difference between the work roll 1 and the abrasive belt 12, the latter may be driven in the same direction as the work roll 1.

The piston rods 11*a* of the hydraulic cylinders 11 are retracted so that the leading end portion 8*a* of the supporting rod 8 causes the pressing member 16 to press against the cylindrical or rolling surface of the work roll 1. The force applied to the work roll 1 by the supporting rod 8 is detected by the load cell 18 and when the force reaches a predetermined value, the hydraulic cylinders 11 are de-energized and then the piston rods 11*a* are locked in the manner described before. The abrasive belt 12 is interposed between the cylindrical or rolling surface of the work roll 1 and the pressing member 16 so that due to the relative displacement between the abrasive belt 12 and the work roll 1, the cylindrical or rolling surface of the work roll is ground. In this case, the spring 19 causes the pressing member 16 to come into intimate contact with the cylindrical or rolling surface of the work roll 1. It is to be understood that instead of locking the piston rods 11*a*, in response to the output signal from the load cell 18, the pressure applied to the hydraulic cylinders 11 may be controlled by the hydraulic control unit (not shown) in such a way that the force applied to the work roll 1 by the pressing member 16 may be maintained constant. Thus the cylindrical or rolling surface of the work roll 1 can be uniformly trued.

The load detected by the load cell 18 is influenced by the tensions applied to the abrasive belt 12. However, as described before, the extended angle $\theta$ of the belt 12 can be sufficiently minimized so that the force applied to the work roll 1 from the belt 12 can be controlled with a high degree of accuracy in practice.

Since the work roll 1 is usually locally worn out at its ends, the main body 4 of the grinding machine is displaced into a position in opposed relationship with such locally worn out roll portion and the locally worn out roll portion is concentrically ground. As described before, in order to traverse the main body 4, the drive means 26 is energized so that the sprocket wheel 25 is rotated and consequently the chain 23 which passes around the sprocket wheels 24 and 25 is driven. Thus, the main body 4 may be traversed and located at any position in opposed relationship with any desired portion of the cylindrical or rolling surface of the work roll 1 for grinding the same.

As described above, according to the present invention, the work roll grinding operation can be carried out without removing it from the rolling mill. That is, while the rolling operation is being carried out, the grinding operation can be simultaneously carried out. As a result, labor saving can be attained and the continous rolling operation can be carried out. In addition, since the abrasive belt 12 is long, its "loading" can be prevented so that the continuous grinding operation can be carried out.

When the abrasive belt 12 is almost wound out from the upper or supply reel 13, it is rewound. In this case, the pressing member 16 is moved away from the work roll 1 and the abrasive belt 12 is quickly wound back around the supply reel 13.

When the work roll 1 is replaced with a new one, it is axially moved with respect to the supporting frames 6 so that it is removed from the rolling mill. In order not to interrupt this operation, the piston rods 11*a* of the hydraulic cylinders 11 are extended so that the supporting rod 8 is moved away from the work roll 1, whereby the pressing member 16 can also be moved away from the work roll 1.

Figure 5:
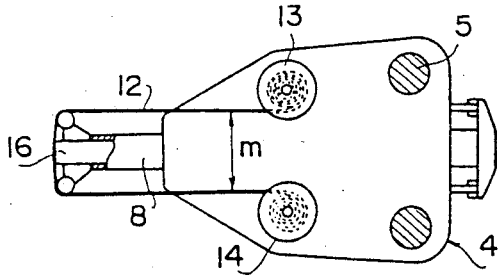
FIG. 5 shows a modification of arrangement of abrasive belt reels.

So far the abrasive belt 12 has been described as being wound around the reels 13 and 14 with its grinding surface directed or facing outwardly (which is referred to as "the winding of the abrasive belt with its grinding surface facing outwardly"), but it is to be understood that the abrasive belt 12 can be wound on the reels 13 and 14 with its grinding surface facing inwardly (which is referred to as "the winding of the abrasive belt with its grinding surface facing inwardly"). In the latter case, as shown in FIG. 5, the distance m between the upper and lower runs of the abrasive belt 12 wound by the reels 13 and 14 can be reduced as compared with the winding system of the abrasive belt with its surface facing outwardly. Therefore this arrangement is adapted to be used in a grinding machine for use in a limited space. Furthermore, guide rolls 27 (See FIG. 1) for reducing the distance between the upper and lower runs of the abrasive belt 12, can be eliminated so that the grinding machine can be simplified in construction. The guide rolls 27 are brought into direct contact with the grinding surface of the abrasive belt 12 so that their wear is excessive. Furthermore the guide rolls 27 are of small diameter so that they tend to cause the abrasive grains to be rapidly separated from the grinding surface of the abrasive belt 12. Such defects can be eliminated by eliminating the guide rolls 27.

Figure 7:
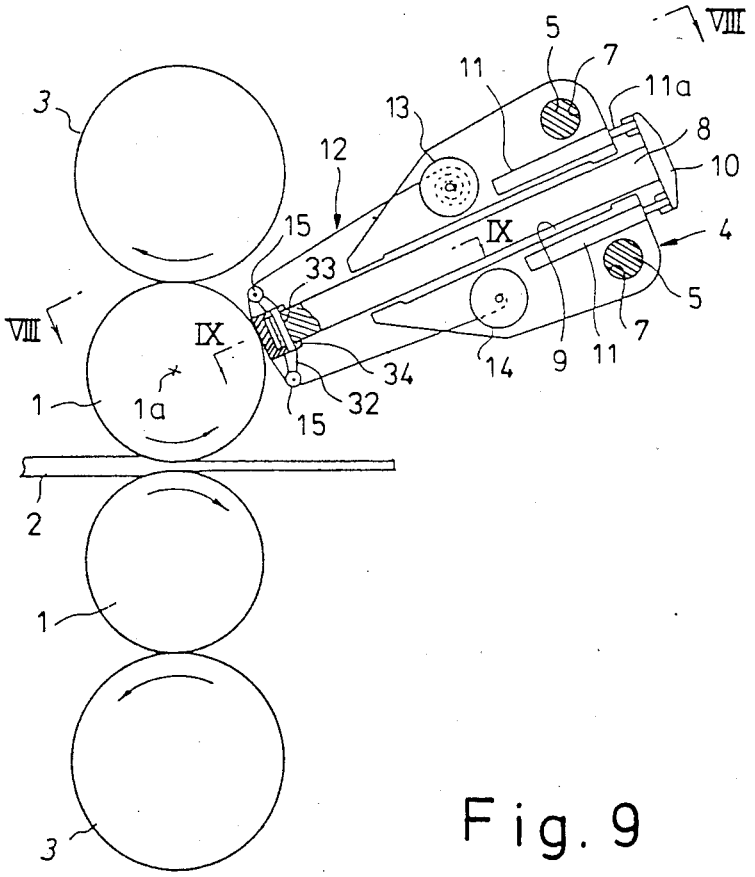
FIG. 7 is a cross sectional view of a second embodiment of a grinding machine in accordance with the present invention.
Figure 9:
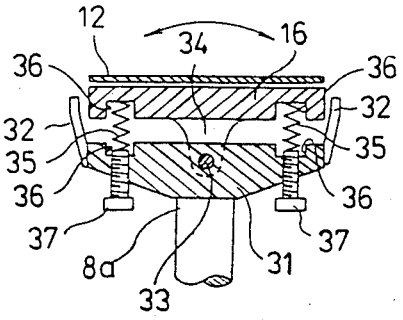
FIG. 9 is a sectional view, on enlarged scale, taken along the line IX—IX of FIG. 7.
Figure 8:
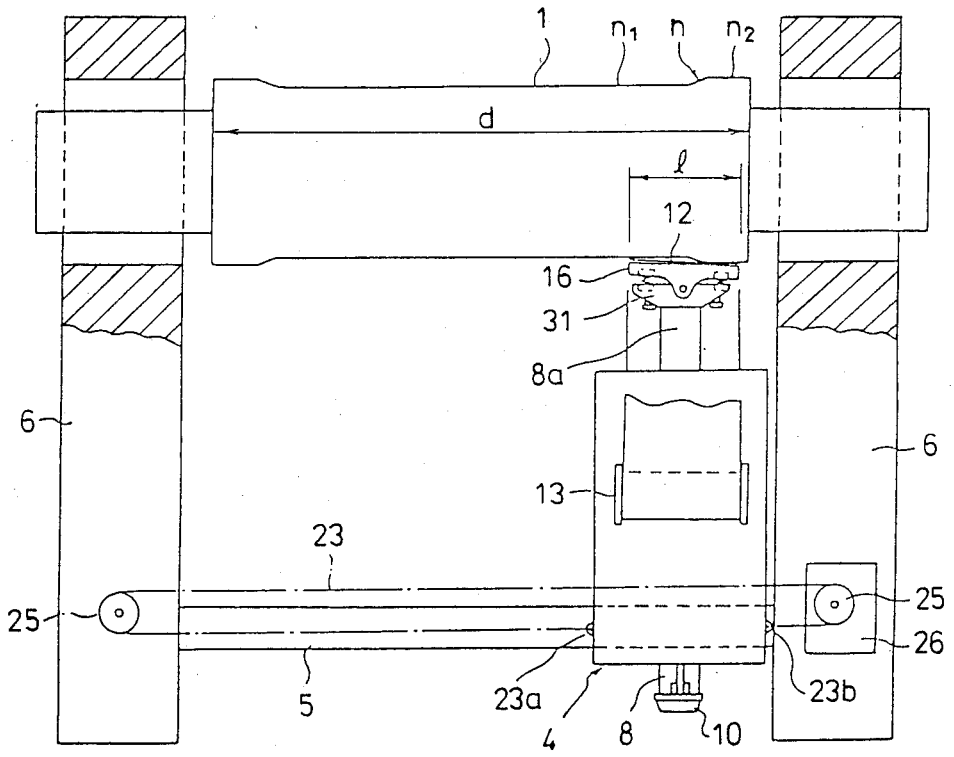
FIG. 8 is a sectional view taken along the line VIII—VIII of FIG. 7.

Second Embodiment, FIGS. 7–9

According to the second embodiment of the present invention, the pressure applied by the abrasive belt 12 to the work roll 1 can be more uniformly distributed. To this end, the pressing member 16 which supports the abrasive belt 12 is pivotably disposed. That is, a bracket 31 is formed integral with the leading end portion 8*a* of the supporting rod 8 and extends in parallel with the work roll 1. Supporting arms 32 for rotatably supporting the belt holding rollers 15 extend from the bracket 31 (See FIGS. 7 and 9). The belt holding rolls 15 are therefore spaced apart from each other by a predetermined distance and support the abrasive belt 12 in such a way that the abrasive belt 12 extends in the tangential direction of the work roll 1 at the leading end portion 8*a* of the supporting rod 8. As shown in FIG. 9, the pressing member 16 which presses the abrasive belt 12 against the cylindrical or rolling surface of the work roll 1 is substantially equal in width to the abrasive belt 12 and a bracket 34 of the pressing member 16 is pivotably mounted with the pivot pin 33 on the bracket 31. That is, the pressing member 16 is so disposed that it may swing within a small angle about the pivot pin 33 in a plane including the bracket 31. Therefore, as shown in FIG. 8, the abrasive belt 12 can be brought into contact with the inclination of a locally worn out portion n of the work roll 1.

Referring back to FIG. 9, in order to maintain the pressing member 16 in parallel with the work roll 1, springs 35 are loaded between the pressing member 16 and the bracket 31. The pressing member 16 and the bracket 31 are formed with recesses 36 which are in opposed relationship with each other and to which are fitted the springs 35. In order to adjust the forces of the springs 35, adjusting screws 37 are threaded through the bracket 31 and made to engage one end respectively of the springs 35 in the recesses 36.

It is to be understood that in order to minimize the friction between the abrasive belt 12 and the pressing member 16, the latter may be provided with a plurality of rolls which support the abrasive belt 12. In addition, the bracket 31 may be separated from the leading end portion 8*a* of the supporting rod 8 and a spring may be loaded between them. (In this case, the belt holding rollers 15 are attached to the leading end portion 8*a* of the supporting rod 8.)

When the main body 4 is traversed to a position in opposed relationship with a locally worn out portion n of the work roll 1, the pressing member 16 is caused to swing about the pivot pin 33 so as to follow the inclination of the locally worn out portion n of the work roll 1. Therefore, the abrasive belt 12 can be uniformly pressed against the locally worn out portion n of the work roll 1 so that the durability of the abrasive belt 12 can be improved. Since the pressing member 16 is urged by the springs 35 in such a way that the pressing member 16 is maintained in parallel with the work roll 1, the abrasive belt 12 is forced to press against the raised portion $n_2$ of the locally worn out portion n rather than the small diameter portion $n_1$. As a result, the raised portion or large diameter portion $n_2$ is ground more than the small diameter portion $n_1$, so that the cylindrical or rolling surface of the work roll 1 can be automatically ground smoothly and uniformly. As described above, the abrasive belt 12 can be brought into intimate contact with the cylindrical or rolling surface of the work roll 1 so that the uniform grinding operation can be carried out even when the axes of the traverse guide beams 5 are inclined more or less with respect to the axis of the work roll 1.

So far the pressing member 16 has been described as being displaced transversely of the work roll 1, but it is to be understood that the pressing member 16 may be equal in width with the work roll 1 and consequently the main body 4 will not traverse.

The effects, features and advantages of the present invention may be summarized as follows:

(1) The cylindrical or rolling surface of the work roll can be ground without removing the work roll from the rolling mill. Therefore, as compared with the conventional system in which the work roll is removed from the rolling mill and then ground, much labor and time can be saved.

(2) The main body of the grinding machine is displaced transversely of the work roll so that the work roll can be uniformly ground. Furthermore, the portion which must be ground can be concentrically ground.

(3) The main body of the grinding machine can be displaced transversely of the work roll. Therefore, the grinding machine accordance with the present invention can be made in compact in size and light in weight and inexpensive to manufacture.

(4) Since the abrasive belt is used, the so-called "loading"; that is, the phenomenon that the removed material chips fill the spaces between grains and thus adhere to the surface, can be avoided so that no dressing is required and consequently a continuous grinding operation is possible. Furthermore, because of (1), labor saving can be attained and the continuous rolling operation can be carried out.

(5) The pressing member is separated from the supporting rod, and spring means are loaded between them so that the pressing member with a low inertia is brought into intimate contact with the cylindrical or rolling surface of the work roll under the force of the spring means. That is, the capability of the pressing member to follow the cylindrical or rolling surface of the work roll is improved. As a consequence, sudden variations in force applied to the work roll and the resulting shock or impact to the abrasive belt can be diminished or absorbed so that variations of the rate of material removal can be minimized. Furthermore the durability of the abrasive belt can be improved.

(6) The pressing member which causes the abrasive belt to be pressed against the cylindrical or rolling surface of the work roll can swing and is so urged as to be in parallel with the work roll. As a result, the lock high-pressure contact of the abrasive belt with the roll surface near a locally worn out portion of the work roll can be avoided so that the durability of the abrasive belt can be improved and the locally worn out portion can be uniformly ground.

What is claimed is:

1. A grinding machine for use with a rolling mill having a work roll with a longitudinal axis, comprising: a main body, means for displacing said main body essentially parallel to said axis, a supporting rod slidably mounted in said main body so as to be movable transverse to said axis and having a leading end, an abrasive belt mounted on said main body and supported by said leading end of said supporting rod, and means for extending or retracting said supporting rod relative to said main body, for pressing said abrasive belt against a circumferential rolling surface of said work roll.

2. A grinding machine according to claim 1, comprising hydraulic cylinder means for extending or retracting said supporting rod.

3. A grinding machine for use with a rolling mill having a work roll with a longitudinal axis, comprising: a main body, means for displacing said main body essentially parallel to said axis, a supporting rod slidably mounted in said main body transverse to said axis and having a leading end, a pressing member attached to said leading end of said supporting rod, an abrasive belt mounted on said main body and supported by said pressing member, and means for extending or retracting said supporting rod and thereby said pressing member for pressing said abrasive belt against a circumferential rolling surface of said work roll.

4. A grinding machine according to claim 3, wherein said pressing member is extendable or retractable with respect to said supporting rod.

5. A grinding machine according to claim 3, wherein said pressing member is pivotally mounted to said supporting rod.

6. A grinding machine according to claim 3, comprising spring means between said pressing member and said leading end of said supporting rod for urging said pressing member toward said work roll.

7. A grinding machine according to claim 3, wherein the leading end of said pressing member comprises roller means.

8. A grinding machine according to claim 3, wherein a load cell is interposed between said pressing member and said supporting rod so as to detect the force applied to said work roll.

9. A grinding machine according to claim 3, wherein belt holding rollers are rotatably disposed in symmetrical relationship with respect to said pressing member, said abrasive belt passing over said belt holding rollers so that the portion of said abrasive belt between said belt holding rollers is maintained nearly flat in the tangential direction of said work roll.

10. A grinding machine according to claim 5, comprising spring means between said pressing member and said leading end of said supporting rod for centering said pressing member.

11. A grinding machine according to claim 3, comprising hydraulic cylinder means for extending or retracting said supporting rod and including piston rod means.

12. A grinding machine according to claim 11, comprising means for locking said piston rod means of said hydraulic cylinder means in position.

13. A grinding machine according to claim 12, comprising means for maintaining pressure in said hydraulic cylinder means at a predetermined level.

14. A grinding machine according to claim 3, wherein said means for displacing said main body is a chain attached to said body.

15. A grinding machine according to claim 3, wherein the width of said abrasive belt is smaller than that of said work roll.

16. A grinding machine according to claim 3, wherein ends of said abrasive belt are wound around two reels which in turn are mounted on said main body, whereby said abrasive belt is unwound from one of said reels and taken up by the other reel and consequently said abrasive belt is moved relative to said work roll.

17. A grinding machine according to claim 16, wherein said abrasive belt is wound around said reels such that the grinding surface of said abrasive belt faces inwardly.

* * * * *